US006031553A

United States Patent [19]

Nagamoto et al.

[11] Patent Number: 6,031,553

[45] Date of Patent: Feb. 29, 2000

[54] HEAT ACTIVATION METHOD FOR THERMOSENSITIVE ADHESIVE LABEL, AND HEAT ACTIVATION APPARATUS AND LABEL PRINTER FOR THE SAME

[75] Inventors: Masanaka Nagamoto; Takanori Motosugi; Toshinobu Iwata, all of Shizuoka; Hiroyuki Idenawa, Kanagawa, all of Japan

[73] Assignee: Ricoh Company, Ltd., Tokyo, Japan

[21] Appl. No.: 08/953,862

[22] Filed: Oct. 16, 1997

[30] Foreign Application Priority Data

Oct. 18, 1996 [JP] Japan ..... 8-275978
Oct. 18, 1996 [JP] Japan ..... 8-275979

[51] Int. Cl.[7] ..... B41J 2/315

[52] U.S. Cl. ..... 347/171

[58] Field of Search ..... 347/171, 218, 347/221; 400/120.01; 156/351, 361, 378, 222, 384; 503/201

[56] References Cited

U.S. PATENT DOCUMENTS

| | | | |
|---|---|---|---|
| 3,779,829 | 12/1973 | Wolff | 156/361 |
| 4,397,709 | 8/1983 | Schwenzer | 156/351 |
| 4,590,497 | 5/1986 | Shibata et al. | 503/201 |
| 4,777,079 | 10/1988 | Nagamoto et al. | 428/212 |
| 5,053,267 | 10/1991 | Ide et al. | 428/195 |
| 5,110,389 | 5/1992 | Hiyoshi et al. | 156/234 |
| 5,248,543 | 9/1993 | Yamaguchi et al. | 428/195 |
| 5,773,385 | 6/1998 | Katoh et al. | 503/200 |

*Primary Examiner*—N. Le
*Assistant Examiner*—Michael Nghiem

[57] ABSTRACT

A heat activation method for activating a thermosensitive adhesive label having a support and a thermosensitive adhesive layer which is provided on the support and is not adhesive at room temperature, so as to make the thermosensitive adhesive layer adhesive with the application of heat thereto, includes the step of heating the thermosensitive adhesive layer to make the thermosensitive adhesive layer adhesive while transporting the label along a heat-resistant transporting belt heated by a heater, with the thermosensitive adhesive layer being in pressure contact with the transporting belt using a pressure-application member. A heat activation apparatus is provided with a heat-application and transporting member and a pressure-application member. A label printer is provided with a label holder, a printing apparatus, a cutter and the above-mentioned heat activation apparatus.

40 Claims, 4 Drawing Sheets

(a)

(b)

(c)

HEAT ACTIVATION METHOD FOR THERMOSENSITIVE ADHESIVE LABEL, AND HEAT ACTIVATION APPARATUS AND LABEL PRINTER FOR THE SAME

BACKGROUND OF THE INVENTION

1. Field of the Invention

The present invention relates to a heat activation method for a thermosensitive adhesive label comprising a support, and a thermosensitive adhesive layer which is formed on the support without a liner (i.e., a disposable backing sheet) and is not adhesive at room temperature, but can be made adhesive with the application of heat thereto.

The present invention also relates to an apparatus for heat-activating the above-mentioned thermosensitive adhesive layer of the thermosensitive adhesive label and a label printer capable of printing images on the thermosensitive adhesive label and heat-activating the thermosensitive adhesive layer thereof.

2. Discussion of Background

Recently, a recording label, in particular, a thermosensitive recording label has been used in a wide variety of fields, for example, in the system of point of sales (POS). In most of the above-mentioned conventional thermosensitive recording labels, a pressure-sensitive adhesive layer is generally provided on the back side of a thermosensitive recording layer, so that the label is stored in such a fashion that a liner (i.e., disposable backing sheet) is attached to the pressure-sensitive adhesive layer.

Such a thermosensitive recording label is useful, but it has some shortcomings. For instance, the liner must be discarded after being released from the adhesive layer. Therefore, consideration must be given to the problem of waste disposal from the ecological viewpoint. In addition, the manufacturing cost is increased because of not only the cost of the liner itself, but also expenses involved by the treatment of the liner.

To solve the above-mentioned problems, there are proposed recording labels without a liner. For instance, as disclosed in Japanese Laid-Open Utility Model Applications 59-43979 and 59-46265 and Japanese Laid-Open Patent Application 60-54842, it is proposed to employ an adhesive layer comprising a pressure-sensitive adhesive in micro-capsule form, and to provide a releasing agent layer on the surface of the recording label, opposite to the pressure-sensitive adhesive layer side so that the recording label may be stored in the form of a roll. By the above-mentioned conventional proposals, however, sufficient adhesion is not generated in the pressure-sensitive adhesive prepared in the form of micro-capsules, and printing cannot be carried out on the surface of the label when the releasing agent layer is provided thereon.

Furthermore, there is proposed a thermosensitive adhesive label comprising a thermosensitive adhesive layer with no liner being attached thereto, as disclosed in Japanese Patent Publication 60-24011 and Japanese Utility Model Publication 60-25371. When such a recording label comprising a thermosensitive adhesive layer is employed, it is necessary to heat-activate the thermosensitive adhesive layer by the application of heat thereto so as to make the thermosensitive adhesive layer sufficiently adhesive.

There is proposed a heat activation method for the above-mentioned thermosensitive adhesive layer, as disclosed in Japanese Patent Publication 60-24011. According to this heat activation method, the thermosensitive adhesive label is transported along a heat-resistant transporting belt with the thermosensitive adhesive layer of the label in contact with the surface of the transporting belt. In this case, the transporting belt is heated by a heater which is situated on the opposite side to the thermosensitive adhesive label with respect to the belt. The heat-resistant transporting belt is heated by the heater, and the thermal energy thus generated is transmitted to the thermosensitive adhesive layer of the label, thereby achieving the heat-activation of the thermosensitive adhesive layer.

However, the heat-activating efficiency is poor when the thermosensitive adhesive label is heat-activated by the above-mentioned heat activation method. This is because the thermosensitive adhesive label is just put on the transporting belt, so that the thermosensitive adhesive label does not closely adhere to the transporting belt.

According to Japanese Utility Model Publication 60-25371, there is disposed a hot-air generating apparatus at a predetermined distance from a transporting belt. The thermosensitive adhesive layer of the thermosensitive adhesive label is heat-activated in such a manner that the thermosensitive adhesive label is exposed to hot air generated by the above-mentioned hot-air generating apparatus while the label is transported along the heat-resistant transporting belt, with the thermosensitive adhesive layer in contact with the transporting belt.

This heat activation method employs hot air, so that the safety of the heat activation apparatus for the thermosensitive adhesive label cannot be ensured, and the heat activation apparatus cannot be made compact because the heat activation apparatus must be equipped with the hot-air generating mechanism.

Furthermore, in the above-mentioned heat activation methods as disclosed in Japanese Patent Publication 60-24011 and Japanese Model Utility Publication 60-25371, for the purpose of smoothly separating the heat-activated thermosensitive adhesive label from the transporting belt, the transporting belt is bent with forming a sharp angle at the position where the thermosensitive adhesive label is separated from the transporting belt. Such a bend of the belt will induce deterioration soon. In addition, a metal which is most suitable for the transporting belt because of its high thermal conductivity cannot be used as the material for the transporting belt. This is because it is hard to bend a metallic belt with forming an acute angle without causing the deterioration.

SUMMARY OF THE INVENTION

Accordingly, a first object of the present invention is to provide a heat activation method for a thermosensitive adhesive label comprising a support and a thermosensitive adhesive layer which is formed on the support and is not adhesive at room temperature, which heat activation method can be efficiently carried out without increasing the size of an apparatus for heat-activating the thermosensitive adhesive label, and by which heat activation method the heat-activated thermosensitive adhesive label can be easily separated from a member for transporting and heating the adhesive label.

A second object of the present invention is to provide an apparatus for heat-activating the above-mentioned thermosensitive adhesive label by the above-mentioned method.

A third object of the present invention is to provide a label printer capable of printing images on a thermosensitive coloring layer of the thermosensitive adhesive label and heat-activating a thermosensitive adhesive layer thereof.

The first object of the present invention can be achieved by a heat activation method for activating a thermosensitive adhesive label comprising a support and a thermosensitive adhesive layer which is provided on the support and is not adhesive at room temperature, so as to make the thermosensitive adhesive layer adhesive with the application of heat thereto, comprising the step of heating the thermosensitive adhesive layer so as to make the thermosensitive adhesive layer adhesive while transporting the thermosensitive adhesive label along a heat-resistant transporting belt which is heated by a heater, with the thermosensitive adhesive layer being in pressure contact with the transporting belt using a pressure-application member.

The second object of the present invention can be achieved by an apparatus for heat-activating a thermosensitive adhesive label comprising a support and a thermosensitive adhesive layer which is provided on the support and is not adhesive at room temperature, so as to make the thermosensitive adhesive layer adhesive with the application of heat thereto, comprising a heat-application and transporting member for heating the thermosensitive adhesive layer of the thermosensitive adhesive label so as to make the thermosensitive adhesive layer adhesive while transporting the thermosensitive adhesive label, and a pressure-application member for bringing the thermosensitive adhesive layer of the thermosensitive adhesive label into pressure contact with the heat-application and transporting member.

The third object of the present invention can be achieved by a label printer which comprises a label holder for holding a thermosensitive adhesive label comprising a support, a thermosensitive adhesive layer which is provided on one side of the support and is not adhesive at room temperature, and a thermosensitive coloring layer provided on the other side of the support, opposite to the thermosensitive adhesive layer with respect to the support; a printing apparatus for printing an image on the thermosensitive coloring layer of the thermosensitive adhesive label; a cutter for cutting the thermosensitive adhesive label to a predetermined length; and a heat activator for heat-activating the thermosensitive adhesive layer of the thermosensitive adhesive label so as to make the thermosensitive adhesive layer adhesive, the heat activator comprising a heat-application and transporting member for heating the thermosensitive adhesive layer of the thermosensitive adhesive label while transporting the thermosensitive adhesive label, and a pressure-application member for bringing the thermosensitive adhesive layer of the thermosensitive adhesive label into pressure contact with the heat-application and transporting member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
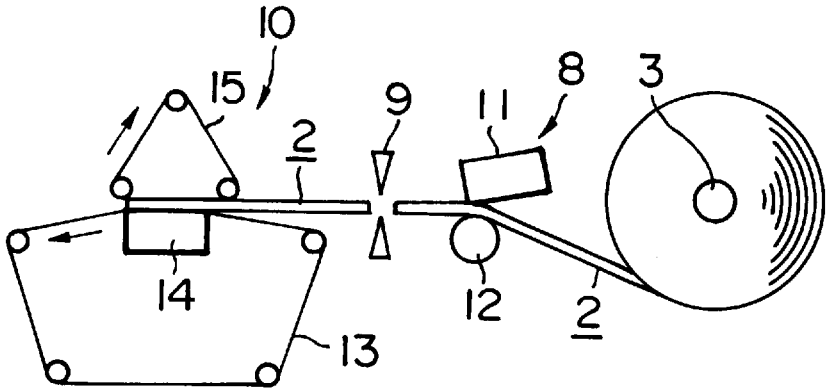
FIG. 1 is a schematic view which shows one example of a label printer according to the present invention which is used for a thermosensitive adhesive label comprising a support, a thermosensitive coloring layer provided on one side of the support, and a thermosensitive adhesive layer provided on the other side of the support.

A heat activation method for activating a thermosensitive adhesive label comprising a support and a thermosensitive adhesive layer which is provided on the support and is not adhesive at room temperature comprises the step of heating the thermosensitive adhesive layer so as to make the thermosensitive adhesive layer adhesive while transporting the thermosensitive adhesive label along a heat-resistant transporting belt which is heated by a heater, with the thermosensitive adhesive layer being in pressure contact with the transporting belt using a pressure-application member.

By use of the pressure-application member, the thermosensitive adhesive layer of the thermosensitive adhesive label is closely urged to the heat-resistant transporting belt which is heated by a heater, so that the thermal energy can be efficiently transmitted from the transporting belt to the thermosensitive adhesive layer. Thus, the heat activation of the thermosensitive adhesive layer can be carried out with high efficiency, and sufficient adhesion can be generated in the thermosensitive adhesive layer.

The heat activation method of the present invention may further comprise the step of separating the thermosensitive adhesive label from the transporting belt after heat-activating the thermosensitive adhesive layer. In this case, the thermosensitive adhesive label may be curved in a direction away from the heat-resistant transporting belt. In the present invention, it is preferable that the thermosensitive adhesive label be separated from the transporting belt with the application of pressure to a linear superimposed area of the thermosensitive adhesive label and the transporting belt using a pressure-application separator so as to make the linear superimposed area concave, which linear superimposed area extends in the direction normal to the transporting direction of the thermosensitive adhesive label.

The above-mentioned pressure-application separator may comprise a press roller or a press plate.

Due to the previously mentioned separating step, the separating performance of the heat-activated thermosensitive adhesive label from the transporting belt can be improved. Therefore, it is not necessary to extremely sharply bend the transporting belt at the position where the heat-activated thermosensitive adhesive label is bound to separate from the transporting belt. As a result, the deterioration of the transporting belt can be prevented.

The thermosensitive adhesive label for use in the present invention may further comprise a thermosensitive coloring layer which is provided on the support, opposite to the thermosensitive adhesive layer with respect to the support. In this case, images can be recorded on the thermosensitive coloring layer by the application of heat to the thermosensitive coloring layer to induce color development therein.

It is preferable that the coloring initiation temperature of the thermosensitive coloring layer be higher than a heat activation temperature of the thermosensitive adhesive layer by 10° C. or more. In such a case, the color development of the thermosensitive coloring layer can be prevented even though the thermal energy is applied to the thermosensitive adhesive label in the course of the heat activation of the thermosensitive adhesive layer. Thus, it becomes possible to prevent the color development on the background of the thermosensitive coloring layer.

When the thermosensitive coloring layer is provided on the support, it is preferable to provide a heat insulating layer between the support and the thermosensitive coloring layer, and/or between the support and the thermosensitive adhesive layer. By the provision of the heat insulating layer between the support and the thermosensitive adhesive layer, the thermal energy applied to the thermosensitive adhesive layer can be efficiently utilized for the heat activation thereof. Further, during the heat activation of the thermosensitive adhesive layer, heat conduction to the thermosensitive coloring layer can be interrupted by such a heat insulating layer, so that the color development of the thermosensitive coloring layer can be efficiently prevented.

Furthermore, to improve the heat insulating effect of the heat insulating layer, it is preferable that the heat insulating layer be a non-expandable heat insulating layer comprising minute void particles with a voidage of 30% or more, each comprising a thermoplastic resin for forming a shell.

In light of the previously mentioned advantages of the heat activation method of the present invention, there is also provided an apparatus for heat-activating a thermosensitive adhesive label comprising a support and a thermosensitive adhesive layer which is provided on the support and is not adhesive at room temperature, so as to make the thermosensitive adhesive layer adhesive with the application of heat thereto. The heat activation apparatus according to the present invention comprises a heat-application and transporting member for heating the thermosensitive adhesive layer of the thermosensitive adhesive label so as to make the thermosensitive adhesive layer adhesive while transporting the thermosensitive adhesive label, and a pressure-application member for bringing the thermosensitive adhesive layer of the thermosensitive adhesive label into pressure contact with the heat-application and transporting member.

In the above-mentioned heat activation apparatus, the heat-application and transporting member may be a heat-resistant transporting belt which is heated by a heater.

By using the above-mentioned heat activation apparatus, the thermal energy can be efficiently transmitted from the heat-resistant transporting belt to the thermosensitive adhesive layer, thereby increasing the efficiency of the heat activating operation and generating sufficient adhesion in the thermosensitive adhesive layer.

In the above-mentioned heat activation apparatus, it is preferable to employ a pressure-application roller as the pressure-application member. By use of the pressure-application roller, the thermosensitive adhesive layer can be surely brought into pressure contact with the transporting belt, so that the heat activating efficiency can be increased, and the sufficient adhesion can be imparted to the thermosensitive adhesive layer.

Alternatively, a pressure-application belt may be used as the pressure-application member for use in the heat activation apparatus. In this case, a relatively large area of the thermosensitive adhesive layer can be heated with the thermosensitive adhesive layer in pressure contact with the heated transporting belt.

In the heat activation apparatus of the present invention it is preferable that the heat-resistant transporting belt comprise a surface portion which has a peel strength of 2 g/mm or less with respect to the heat-activated thermosensitive adhesive layer. The above-mentioned peel strength is measured by applying the thermosensitive adhesive layer to the surface portion of the heat-resistant transporting belt, heating the thermosensitive adhesive layer to 90° C. for one minute under the application of a load of 2 kg thereto, and measuring the force required to peel the thermosensitive adhesive layer from the surface portion of the transporting belt under T-peel condition at room temperature at a peeling speed of 300 mm/minute.

For example, it is preferable that the surface portion of the heat-resistant transporting belt comprise a silicone rubber or a silicone resin.

Thus, the heat-activated thermosensitive adhesive label can be smoothly separated from the transporting belt without sticking to the surface of the transporting belt after the completion of heat activation.

The heat activation apparatus of the present invention may further comprise the previously mentioned separator for separating the thermosensitive adhesive label from the transporting belt after heat-activating the thermosensitive adhesive layer. The pressure may be applied to the linear superimposed area of the thermosensitive adhesive label and the transporting belt so as to make the linear superimposed area concave using a pressure-application separator. In this case, the thermosensitive adhesive label is easily curved in a direction away from the transporting belt. Therefore, as previously mentioned, it is not necessary to sharply bend the transporting belt, so that a metal with high thermal conductivity can be used as a material for the transporting belt.

According to the present invention there can be provided a label printer. The label printer of the present invention comprises a label holder for holding a thermosensitive adhesive label comprising a support, a thermosensitive adhesive layer which is provided on one side of the support and is not adhesive at room temperature, and a thermosensitive coloring layer provided on the other side of the support, opposite to the thermosensitive adhesive layer with respect to the support; a printing apparatus for printing an image on the thermosensitive coloring layer of the thermosensitive adhesive label; a cutter for cutting the thermosensitive adhesive label to a predetermined length; and a heat activator for heat-activating the thermosensitive adhesive layer of the thermosensitive adhesive label so as to make the thermosensitive adhesive layer adhesive, the heat activator comprising a heat-application and transporting member for heating the thermosensitive adhesive layer of the thermosensitive adhesive label while transporting the thermosensitive adhesive label, and a pressure-application member for bringing the thermosensitive adhesive layer of the thermosensitive adhesive label into pressure contact with the heat-application and transporting member.

In this label printer, the above-mentioned printing apparatus and cutter may be arranged in any order.

By using the above-mentioned label printer, image printing can be carried out on the thermosensitive adhesive label, and the label can be cut to a predetermined length, and then the thermosensitive adhesive layer of the label can be heat-activated very efficiently. The thus obtained label carrying the image thereon can be attached to a label-receiving member very smoothly by using the label printer of the present invention because sufficient adhesion can be readily generated in the thermosensitive adhesive layer by the heat activation.

The heat activator for use in the above-mentioned label printer may further comprise the previously mentioned separator, such as a pressure-application separator, for smoothly separating the heat-activated thermosensitive adhesive label from the transporting belt after heat-activating the thermosensitive adhesive layer.

Figure 2:
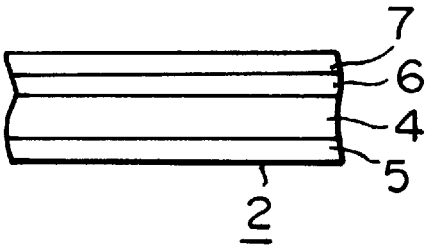
FIG. 2 is a schematic cross-sectional view of one example of a thermosensitive adhesive label for use in the present invention.

FIG. 1 is a schematic view which shows one example of the above-mentioned label printer according to the present invention, which is used for a thermosensitive adhesive label, for example, as shown in FIG. 2.

A thermosensitive adhesive label as shown in FIG. 2 comprises a support 4, for instance, a sheet of high quality paper, a thermosensitive adhesive layer 5 on the back side of the support 4, and a heat insulating layer 6 and a thermosensitive coloring layer 7 which are successively overlaid on the front side of the support 4, opposite to the thermosensitive adhesive layer 5 with respect to the support 4.

As shown in FIG. 1, a thermosensitive adhesive label 2 is held in the form of a roll by a label holder 3. The thermosensitive adhesive label 2 is caused to pass through a printing apparatus 8 for printing images on the thermosensitive coloring layer 7 of the thermosensitive adhesive label 2 by the application of heat thereto; a cutter 9 for cutting the thermosensitive adhesive label 2 to a predetermined length; and a heat activator 10 for heat-activating the thermosensitive adhesive layer 5 of the thermosensitive adhesive label 2.

The printing apparatus B comprises a thermal head 11 for printing an image on the thermosensitive coloring layer 7 of the label 2 by the application of heat thereto, and a platen roller 12 for holding and transporting the thermosensitive adhesive label 2.

The heat activator 10 comprises a heat-resistant transporting belt 13 for transporting the above-mentioned thermosensitive adhesive label 2 with the thermosensitive adhesive layer of the label 2 in pressure contact with the surface of the transporting belt 13; a heater such as a ceramic heater 14 for applying thermal energy to the thermosensitive adhesive layer of the label 2 via the transporting belt 13, which is situated in contact with the inner surface of the transporting belt 13; and a pressure-application belt 15 for urging the thermosensitive adhesive label 2 toward the transporting belt 13 while the adhesive label 2 is transported along the transporting belt 13. The above-mentioned platen roller 12 for use in the printing apparatus 8 and the transporting belt 13 for use in the heat activator 10 are separately connected to a drive unit and driven in rotation.

Any material is available for the heat-resistant transporting belt 13 as long as the belt is not easily deformed or elongated when it is driven in rotation under the application of heat thereto.

Specific examples of the material for the transporting belt 13 are plastic materials such as Teflon and polyester; and metals such as nickel and aluminum.

The surface of the heat-resistant transporting belt 13 may have releasability with respect to the heat-activated thermosensitive adhesive layer of the thermosensitive adhesive label 2. To be more specific, as previously mentioned, it is preferable that the heat-resistant transporting belt 13 comprise a surface portion which has a peel strength of 2 g/mm or less, preferably 1 g/mm or less, with respect to the heat-activated thermosensitive adhesive layer.

In order to obtain the above-mentioned peel strength, for example, the surface portion of the transporting belt 13 may comprise a silicone rubber or silicone resin, and such a surface portion may be made rough, for example, by sand-blasted finish or plasma coating.

The heat-resistant transporting belt 13 may be heated by use of a heater such as a ceramic heater 14 or halogen lamp, as shown in FIG. 1. Alternatively, for example, a heater may be attached to the heat-resistant transporting belt 13.

Any material can be used for the pressure-application belt 15 for use in the heat activator 10 so long as it is possible to uniformly apply the pressure to the transporting belt 13, The material for the pressure-application belt 15 is not limited, but the same material as employed for the heat-resistant transporting belt 13 is preferable. In addition, it is desirable that the pressure applied to the transporting belt 13 by the pressure-application belt 15 be to such a degree that air existing between the thermosensitive adhesive layer of the thermosensitive adhesive label 2 and the transporting belt 13 can be forced out.

Instead of the pressure-application belt 15, a pressure-application roller or a pressure-application plate may be employed in the present invention.

Examples of the material for the pressure-application roller include metals, rubbers and plastic materials. It is preferable that the surface portion of the pressure-application roller comprise a rubber or plastic material having a spring type hardness of 80° or less when measured using a spring type hardness tester type A according to JIS K6301 so as to uniformly apply pressure to the thermosensitive adhesive label.

The thermosensitive adhesive label, of which the thermosensitive adhesive layer can be made adhesive by the heat activation method of the present invention, is not limited to the above-mentioned thermosensitive adhesive label comprising a thermosensitive coloring layer. The thermosensitive adhesive label may comprise a colored printing layer, an image-receiving layer capable of receiving images from a thermal image transfer ink ribbon, an image-receiving layer capable of forming images by ink-jet image printing, an image-receiving layer capable of receiving images from a sublimation type thermal image transfer ink ribbon, and an electrostatic recording layer.

Other features of this invention will become apparent in the course of the following description of exemplary embodiments, which are given for illustration of the invention and are not intended to be limiting thereof.

EXAMPLE 1

[Preparation of Thermosensitive Adhesive Label]

(Formation of heat insulating layer)

The following components were ground and dispersed in a ball mill until the average particle size reached 2.0 $\mu$m or less, so that a coating liquid for a heat insulating layer was prepared:

| | Parts by Weight |
|---|---|
| Aqueous dispersion of minute void particles (copolymer resin comprising vinylidene chloride and acrylonitrile as the main components) | 30 |

-continued

| | Parts by Weight |
|---|---|
| (solid content: 32 wt. %, average particle diameter: 5 μm, and voidage: 92%) | |
| Styrene - butadiene copolymer latex (solid content: 47.5 wt. %) | 5 |
| Water | 65 |

The thus prepared heat insulating layer coating liquid was coated on a sheet of high quality paper serving as a support, and dried in such a fashion that the deposition amount of the coating liquid was 5 g/m$^2$ on a dry basis. Thus, a non-expandable heat insulating layer was provided on the support.

(Formation of thermosensitive coloring layer)

A mixture of the following components was separately dispersed and pulverized in a ball mill until the average particle size reached 2.0 μm or less, thereby obtaining a Liquid A and a Liquid B:

[Liquid A]

| | Parts by Weight |
|---|---|
| 3-dibenzylamino-6-methyl-7-anilinofluoran | 20 |
| 10% aqueous solution of polyvinyl alcohol | 20 |
| Water | 60 |

[Liquid B]

| | Parts by Weight |
|---|---|
| 4-hydroxy-4'-isopropoxy-diphenyl sulfone | 10 |
| 10% aqueous solution of polyvinyl alcohol | 25 |
| Calcium carbonate | 15 |
| Water | 50 |

One part by weight of the Liquid A and eight parts by weight of the Liquid B were mixed and stirred, so that a thermosensitive coloring layer coating liquid was prepared.

On the above obtained heat insulating layer, the thermosensitive coloring layer coating liquid was coated and dried in such a fashion that the deposition amount of the coating liquid was 5 g/m$^2$ on a dry basis. Then, the surface of the coated layer was subjected to super-calendering to have a surface smoothness of 600 to 700 sec in terms of Bekk's smoothness, so that a thermosensitive coloring layer was provided on the heat insulating layer.

(Formation of thermosensitive adhesive layer)

On the back side of the support, opposite to the side of the thermosensitive coloring layer with respect to the support, a commercially available thermosensitive adhesive "DLA-1" (Trademark), made by Dainippon Ink & Chemicals, Incorporated, with a solid content of 50 wt. % was coated and dried in such a fashion that the deposition amount of the adhesive was 25 g/m$^2$ on a dry basis, so that a thermosensitive adhesive layer was provided on the support.

Thus, a thermosensitive adhesive label No. 1 for use in the present invention was obtained.

The coloring initiation temperature of the thermosensitive coloring layer was higher than a heat activation temperature of the thermosensitive adhesive layer by about 45° C.

The thus obtained thermosensitive adhesive label No. 1 was set to the label holder 3 of the label printer as shown in FIG. 1. With pulling the thermosensitive adhesive label No. 1 (indicated by reference numeral 2 in FIG. 1) out of the label holder 3, the thermosensitive coloring layer ot the label No. 1 was subjected to thermal printing by the application of heat thereto using the thermal head 11.

After the completion of thermal printing, the thermosensitive adhesive label No. 1 was cut to a predetermined length by the cutter 9 and sent to the heat activator 10. The thermosensitive adhesive label No. 1 was transported along the heat-resistant transporting belt 13, with the thermosensitive adhesive layer of the label being in pressure contact with the transporting belt 13 heated by the ceramic heater 14. The thermal energy was transmitted to the thermosensitive adhesive layer of the adhesive label No. 1 via the heat-resistant transporting belt 13 while the thermosensitive adhesive label No. 1 was transported along the transporting belt 13, thereby heat-activating the thermosensitive adhesive layer of the adhesive label No. 1.

In Example 1, as the transporting belt 13, there was employed a silicone-rubber-coated nickel belt.

The thermosensitive adhesive layer of the adhesive label No. 1 was urged toward the heat-resistant transporting belt 13 by the application of pressure to the thermosensitive adhesive label No. 1 using the pressure-application belt 15, thereby forcing out the air between the thermosensitive adhesive layer of the adhesive label No. 1 and the transporting belt 13. Therefore, the thermal energy was efficiently transmitted from the transporting belt 13 to the thermosensitive adhesive layer, and sufficient adhesion was generated in the thermosensitive adhesive layer.

Due to smooth heat-activating operation of the thermosensitive adhesive layer, the operation for attaching the heat-activated thermosensitive adhesive label to a label-receiving member was carried out very efficiently.

Furthermore, because of the provision of the heat insulating layer between the support and the thermosensitive coloring layer in the thermosensitive adhesive label No. 1, the heat conduction was interrupted by the heat insulating layer in the course of heat activation. As a result, it was possible to make the best use of the applied thermal energy for the heat activation.

In addition to the above-mentioned advantage obtained from the formation of the heat insulating layer, the coloring initiation temperature of the thermosensitive coloring layer was set to be higher than the heat activation temperature of the thermosensitive adhesive layer by about 45° C. Therefore, the color development of the thermosensitive coloring layer can be prevented from taking place in the course of the heat activation, so that the density of the background of the thermosensitive coloring layer can be prevented from increasing.

EXAMPLE 2

Figure 3:
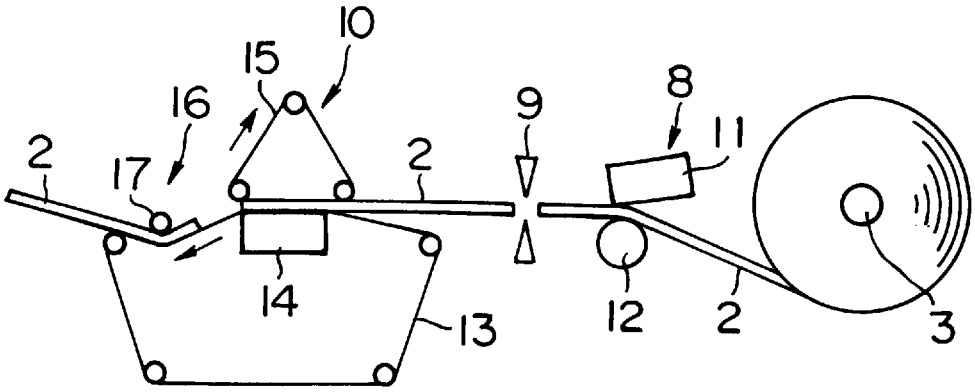
FIG. 3 is a schematic view which shows another example of a label printer according to the present invention.

The procedure for heat-activating the thermosensitive adhesive layer of the thermosensitive adhesive label No. 1 as in Example 1 was repeated except that the label printer employed in Example 1 (as shown in FIG. 1) was modified in such a manner that the heat activator 10 was further provided with a pressure-application separator 16 as shown in FIG. 3 for smoothly separating the heat-activated thermosensitive adhesive label No. 1 from the heat-resistant transporting belt 13.

The pressure-application separator 16 as shown in FIG. 3 comprises a press roller 17 which is situated before the position where the transporting belt 13 turns to a direction to separate the thermosensitive adhesive label No. 1 from the transporting belt 13.

Figure 4:
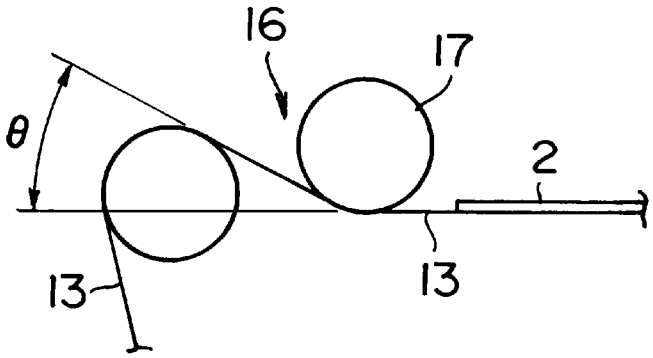
FIGS. 4(*a*), 4(*b*) and 4(*c*) are schematic diagrams in explanation of the separating action of a thermosensitive adhesive label from a transporting belt in the heat activation apparatus of the present invention.
Figure 4:
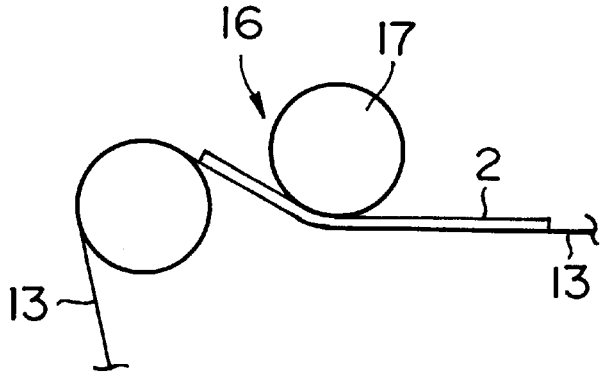
Figure 4:
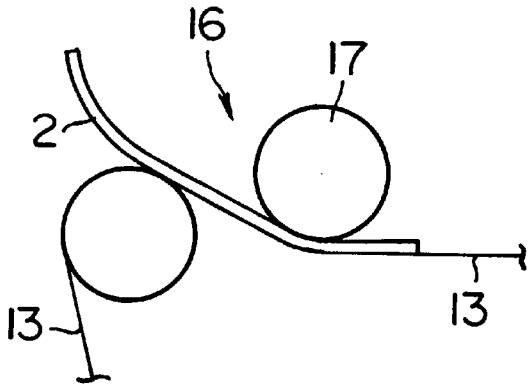

FIGS. 4(*a*) to 4(*c*) are schematic views which explain smooth separation of the thermosensitive adhesive label from the transporting belt because of the provision of the pressure-application separator 16.

As shown in FIG. 4(*a*), a press roller 17 is disposed to press a transporting belt 13 so that the transporting belt 13 may be curved upward at an angle of (θ). Then, a heat-activated thermosensitive adhesive label 2 enters into the nip between the press roller 17 and the transporting belt 13, as shown in FIG. 4(*b*). At that time, pressure is applied by the press roller 17 to a linear superimposed area of the thermosensitive adhesive label 2 and the transporting belt 13, with the linear superimposed area extending in the direction normal to the transporting direction of the thermosensitive adhesive label 2.

Thus, the thermosensitive adhesive label 2 is curved in a direction away from the transporting belt 13, as shown in FIG. 4(*c*), after the thermosensitive adhesive label 2 is caused to pass through the press roller 17.

In Example 2, by the provision of the above-mentioned pressure-application separator 16, the heat-activated thermosensitive adhesive label 2 was smoothly separated from the transporting belt 13 after heat-activation of the thermosensitive adhesive layer. Because it was not necessary to sharply bend the transporting belt 13 at the position where the heat-activated thermosensitive adhesive label 2 was separated from the transporting belt 13. The heat activation of the thermosensitive adhesive layer of the adhesive label 2 was efficiently carried out.

EXAMPLE 3

The procedure for preparation of the thermosensitive adhesive label No. 1 in Example 1 was repeated except that the aqueous dispersion of the minute void particles for use in the coating liquid for the heat insulating layer in Example 1 was replaced by a urea-formaldehyde resin with a solid content of 25 wt. %. Thus, a thermosensitive adhesive label No. 2 for use in the present invention was obtained.

The thus obtained thermosensitive adhesive label No. 2 was subjected to thermal printing of the thermosensitive coloring layer and heat-activation of the thermosensitive adhesive layer using the same label printer (shown in FIG. 1) as employed in Example 1.

EXAMPLE 4

The procedure for preparation of the thermosensitive adhesive label No. 1 in Example 1 was repeated except that the heat insulating layer provided on the high quality paper in Example 1 was omitted. Thus, a thermosensitive adhesive label No. 3 was prepared as shown in FIG. 5.

The thus prepared thermosensitive adhesive label No. 3 was subjected to thermal printing of the thermosensitive coloring layer and heat-activation of the thermosensitive adhesive layer using the same label printer (shown in FIG. 1) as employed in Example 1.

Figure 5:
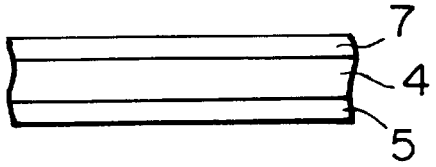
FIG. 5 is a schematic cross-sectional view of another example of a thermosensitive adhesive label for use in the present invention.

Although the heat insulating layer was not provided between the support 4 and the thermosensitive coloring layer 7 in the thermosensitive adhesive label No. 3 as shown in FIG. 5, the heat activation of the thermosensitive adhesive layer 5 was efficiently carried out. This is because the thermosensitive adhesive layer of the thermosensitive adhesive label No. 3 was stably urged to the transporting belt 13 by the application of pressure to the thermosensitive adhesive label No. 3 using the pressure-application belt 15. In addition, since the coloring initiation temperature of the thermosensitive coloring layer was higher than the heat activation temperature of the thermosensitive adhesive layer by about 45° C., the color development of the thermosensitive coloring layer can be prevented from taking place in the course of the heat activation.

EXAMPLE 5

The procedure for preparation of the thermosensitive adhesive label No. 1 in Example 1 was repeated except that the formulation for the Liquid B which was used to prepare the coating liquid for the thermosensitive coloring layer in Example 1 was changed to the following formulation for a Liquid C:

[Formulation for Liquid C]

| | Parts by Weight |
|---|---|
| 4-hydroxy-4-isopropoxy diphenyl sulfone | 10 |
| Di(p-methylbenzyl) oxalate | 3 |
| 10% aqueous solution of polyvinyl alcohol | 25 |
| Calcium carbonate | 15 |
| Water | 47 |

Thus, a thermosensitive adhesive label No. 4 was prepared.

The thus obtained thermosensitive adhesive label No. 4 was subjected to thermal printing of the thermosensitive coloring layer and heat-activation of the thermosensitive adhesive layer using the same label printer (shown in FIG. 1) as employed in Example 1.

EXAMPLE 6

The procedure for preparation of the thermosensitive adhesive label No. 1 in Example 1 was repeated except that the formulation for the Liquid B which was used to prepare the coating liquid for the thermosensitive coloring layer in Example 1 was changed to the following formulation for a Liquid D:

[Formulation for Liquid D]

| | Parts by Weight |
|---|---|
| 4-hydroxy-4-isopropoxydiphenyl-sulfone | 10 |
| p-benzylbiphenyl | 3 |
| 10% aqueous solution of polyvinyl alcohol | 25 |
| Calcium carbonate | 15 |
| Water | 47 |

Thus, a thermosensitive adhesive label No. 5 was prepared.

The thus obtained thermosensitive adhesive label No. 5 was subjected to thermal printing of the thermosensitive coloring layer and heat-activation of the thermosensitive adhesive layer using the same label printer (shown in FIG. 1) as employed in Example 1.

EXAMPLE 7

The procedure for preparation of the thermosensitive adhesive label No. 1 in Example 1 was repeated except that the same coating liquid for the heat insulating layer as employed in Example 1 was further coated on the back side of the high quality paper serving as a support, and dried in such a fashion that the deposition amount of the coating liquid was 3 g/m$^2$ on a dry basis before providing the thermosensitive adhesive layer. Thus, a non-expandable heat insulating layer was provided on both sides of the support. Thus, a thermosensitive adhesive label No. 6 for use in the present invention was obtained.

Figure 6:
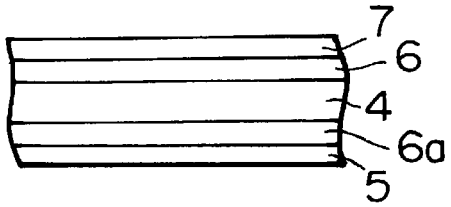
FIG. 6 is a schematic cross-sectional view of a further example of a thermosensitive adhesive label for use in the present invention.

FIG. 6 is a schematic cross-sectional view of the thermosensitive adhesive label No. 6. As shown in FIG. 6, a heat insulating layer 6 and a thermosensitive coloring layer 7 are successively overlaid on a support 4, and on the opposite side of the support 4, there are provided a heat insulating layer 6*a* and a thermosensitive adhesive layer 5.

The thus obtained thermosensitive adhesive label No. 6 was subjected to thermal printing of the thermosensitive coloring layer and heat-activation of the thermosensitive adhesive layer using the same label printer (shown in FIG. 1) as employed in Example 1.

By the provision of the heat insulating layer 6*a*, the thermal energy applied to the thermosensitive adhesive layer 5 was more effectively prevented from escaping therefrom, so that the efficiency of the heat activating operation was further increased. In addition, the color development of the thermosensitive coloring layer 7 was prevented more effectively.

EXAMPLE 8

The procedure for preparation of the thermosensitive adhesive label No. 1 in Example 1 was repeated except that the commercially available thermosensitive adhesive "DLA-1" (Trademark), made by Dainippon Ink & Chemicals, Incorporated was replaced by a commercially available thermosensitive adhesive "DT-200" (Trademark), made by Regitex Co., Ltd., with a solid content of 58 wt. %.

Thus, a thermosensitive adhesive label No. 7 was prepared.

The thus obtained thermosensitive adhesive label No. 7 was subjected to thermal printing of the thermosensitive coloring layer and heat-activation of the thermosensitive adhesive layer using the same label printer (shown in FIG. 1) as employed in Example 1.

EXAMPLE 9

Figure 7:
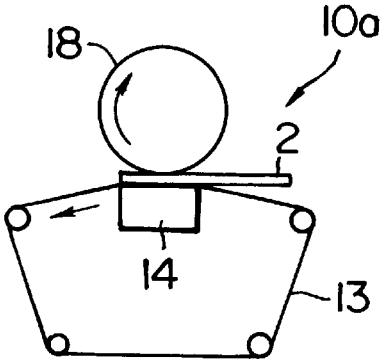
FIGS. 7 to 9 are schematic views, each of which shows an example of a heat activator for use in the label printer according to the present invention.

The procedure for heat-activating the thermosensitive adhesive layer of the thermosensitive adhesive label No. 1 as in Example 1 was repeated except that the heat activator 10 for use in the label printer as shown in FIG. 1 was replaced by a heat activator 10*a* as shown in FIG. 7.

The heat activator 10*a* shown in FIG. 7 comprises a pressure-application roller 18 as the heat-application member instead of the heat-application belt 15 as employed in Example 1.

In Example 9, a rubber roller was used as the pressure-application roller 18.

Although the area to which pressure was applied by use of the pressure-application roller 18 was smaller than that by use of the pressure-application belt 15 as employed in Example 1, the pressure was surely applied to the thermosensitive adhesive label 2. Thus, the heat activation of the thermosensitive adhesive layer of the thermosensitive adhesive label No. 1 was performed efficiently, and the heat-activated thermosensitive adhesive layer was provided with sufficient adhesion,

EXAMPLE 10

Figure 8:
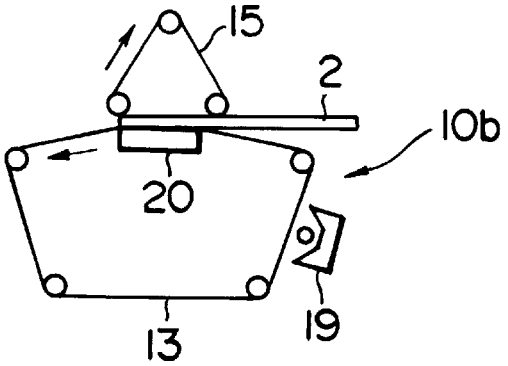

The procedure for heat-activating the thermosensitive adhesive layer of the thermosensitive adhesive label No. 1 as in Example 1 was repeated except that the heat activator 10 for use in the label printer as shown in FIG. 1 was replaced by a heat activator 10*b* as shown in FIG. 8.

In the heat activator 10*b* shown in FIG. 8, a heat-resistant transporting belt 13 is heated by use of a halogen lamp 19. The surface of the transporting belt 13, which comes in contact with the thermosensitive adhesive layer, is coated with Teflon. Further, a Teflon plate 20 is disposed on the inside of the transporting belt 13 so as to be opposite to the pressure-application belt 15. The Teflon plate 20 serves as a member for supporting the thermosensitive adhesive label 2 without bending even though pressure is applied to the thermosensitive adhesive label 2 by the pressure-application belt 15 in order to urge the thermosensitive adhesive label 2 toward the transporting belt 13.

EXAMPLE 11

The procedure for heat-activating the thermosensitive adhesive layer of the thermosensitive adhesive label No. 1 as in Example 1 was repeated except that the heat activator 10 for use in the label printer as shown in FIG. 1 was modified in such a manner that the ceramic heater 14 was replaced by a silicone rubber heater.

EXAMPLE 12

The procedure for heat-activating the thermosensitive adhesive layer of the thermosensitive adhesive label No. 1 as in Example 1 was repeated except that the heat activator 10 for use in the label printer as shown in FIG. 1 was modified in such a manner that the ceramic heater 14 was replaced by a Teflon-coated heat-application roller (with a diameter of 200 mm) having a halogen lamp therein.

EXAMPLE 13

The procedure for heat-activating the thermosensitive adhesive layer of the thermosensitive adhesive label No. 1 as in Example 10 was repeated except that the heat activator 10*b* for use in the label printer employed in Example 10, as shown in FIG. 8, was modified in such a manner that the Teflon-coated transporting belt 13 was replaced by a silicone-rubber-coated transporting belt.

According to this heat activation method, the heat-activated thermosensitive adhesive layer of the adhesive label 2 was smoothly separated from the transporting belt 13, and therefore, the transferring of the heat-activated thermosensitive adhesive to the transporting belt was effectively prevented.

EXAMPLE 14

Figure 9:
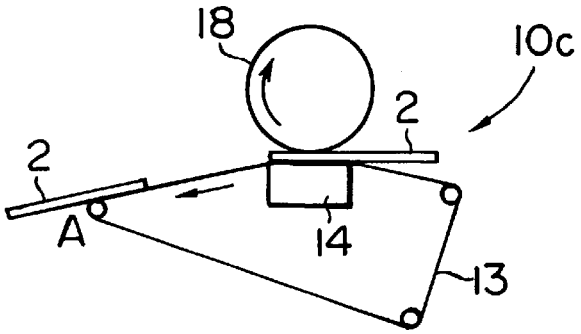

The procedure for heat-activating the thermosensitive adhesive layer of the thermosensitive adhesive label No. 1 as in Example 1 was repeated except that the heat activator 10 for use in the label printer as shown in FIG. 1 was replaced by a heat activator 10*c* as shown in FIG. 9.

In the heat activator 10*c* shown in FIG. 9, a heat-resistant transporting belt 13 is sharply bent at the position A where the heat-activated thermosensitive adhesive label 2 is separated from the transporting belt 13. In addition, the heat-application roller 18 is employed as the heat-application member instead of the heat-application belt 15.

By sharply bending the transporting belt 13 at the separating position A, the heat-activated thermosensitive adhesive label 2 was smoothly separated from the transporting belt 13, and the transferring of the heat-activated thermosensitive adhesive to the transporting belt 13 was prevented.

COMPARATIVE EXAMPLE 1

Figure 10:
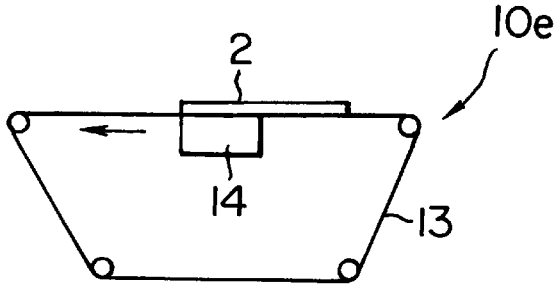
FIGS. 10 and 11 are schematic views, each of which shows an example of a heat activator for use in the comparative label printer.

The procedure for heat-activating the thermosensitive adhesive layer of the thermosensitive adhesive label No. 1 as in Example 1 was repeated except that the heat activator 10 for use in the label printer as shown in FIG. 1 was replaced by a heat activator 10*e* as shown in FIG. 10.

In the heat activator 10*e* shown in FIG. 10, the thermosensitive adhesive label 2 is transported along the heat-resistant transporting belt 13, and no pressure is applied to the thermosensitive adhesive label 2 when the adhesive label 2 is caused to pass through the ceramic heater 14.

COMPARATIVE EXAMPLE 2

Figure 11:
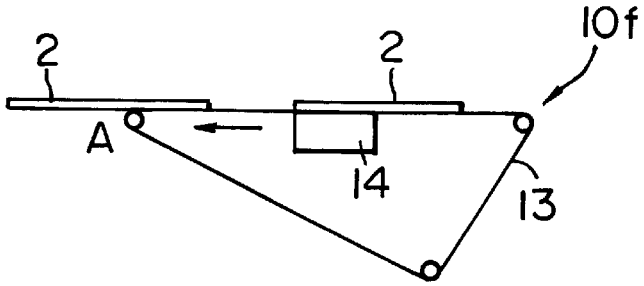

The procedure for heat-activating the thermosensitive adhesive layer of the thermosensitive adhesive label No. 1 as in Example 1 was repeated except that the heat activator 10 for use in the label printer as shown in FIG. 1 was replaced by a heat activator 10*f* as shown in FIG. 11.

In the heat activator 10*f* shown in FIG. 11, the thermosensitive adhesive label 2 is transported along the heat-resistant transporting belt 13, and no pressure is applied to the thermosensitive adhesive label 2 when the adhesive label 2 is caused to pass through the ceramic heater 14. In addition, the transporting belt 13 is sharply bent at the position A where the heat-activated thermosensitive adhesive label 2 is separated from the transporting belt 13.

In Comparative Example 2, a Teflon-coated nickel belt is employed as the transporting belt 13.

Table 1 shows heat-activating conditions of the heat activation methods employed in Examples 1 to 14 and Comparative Examples 1 and 2.

Each heat activation method for the thermosensitive adhesive label employed in Examples 1 to 14 and Comparative Examples 1 and 2 was evaluated with respect to the following aspects:

(1) Adhesion of thermosensitive adhesive layer by heat activation

The adhesion of the thermosensitive adhesive layer which was heat-activated by each heat activation method was examined by touching the adhesive layer with fingers. Then, the adhesion of the thermosensitive adhesive layer was evaluated on the following scale:

◎: The adhesion was very strong and considered to be preferable in practical use.

○: The adhesion was sufficient and the employed heat activation method was acceptable in practical use.

Δ: The adhesion was weak, and the employed heat activation method was not acceptable in practical use.

The results are shown in Table 2.

(2) Transferring of adhesive to transporting belt

The deposition of the thermosensitive adhesive on the surface portion of the transporting belt was visually inspected after the thermosensitive adhesive layer was subjected to heat activation by each heat activation method.

Then, the transferring of the thermosensitive adhesive to the transporting belt was evaluated on the following scale:

◎: No adhesive was observed on the surface portion of the transporting belt by visual inspection.

○: A slight amount of adhesive was observed on the surface portion of the transporting belt by visual inspection, but the employed heat activation method was acceptable in practical use.

Δ: The adhesive transferred to the surface portion of the transporting belt was partially noticeable, and the employed heat activation method was not acceptable in practical use.

The results are shown in Table 2.

(3) Background density of thermosensitive coloring layer in the course of heat activation of thermosensitive adhesive layer The background density of the thermosensitive coloring layer was measured using a McBeth densitometer RD-914 when the thermosensitive adhesive layer was heat-activated by each heat activation method.

The results are shown in Table 2.

(4) Dynamic coloring density of thermosensitive coloring layer

Each thermosensitive adhesive label was loaded in a thermal printing test apparatus equipped with a commercially available thin film head (made by Matsushita Electronic Components Co., Ltd.), and images were thermally printed on the thermosensitive coloring layer under the conditions that the applied electric power was 0.6 W/dot, the period for one line was 10 msec/line and the scanning density was 8×7.7 dot/mm, with the pulse width changed to 0.4 msec and 0.5 msec.

The coloring density of the image recorded on the thermosensitive coloring layer was measured using a McBeth densitometer RD-914.

The results are shown in Table 2.

TABLE 1

| | Transporting Belt | | | | Heating Means | | | | | |
|---|---|---|---|---|---|---|---|---|---|---|
| Example No. | Support member | Material of Surface Portion | Peel Strength with respect to Adhesive Layer (g/mm) | Pressure-application Member | Heater | Heating mode (**) | Separating Means for Label | Difference in Two Temp.(*) | Transporting Speed (mm/sec) | Heat Activation Temp. (° C.) |
| Ex. 1 | Nickel | Silicone rubber | 0.5 | Belt | Ceramic heater | (A) | — | 45 | 100 | 120<br>80<br>50 |
| Ex. 2 | Nickel | Silicone rubber | 0.5 | Belt | Ceramic heater | (A) | Provision of press roller | 45 | 100 | 120 |
| Ex. 3 | Nickel | Silicone rubber | 0.5 | Belt | Ceramic heater | (A) | — | 45 | 100 | 120 |
| Ex. 4 | Nickel | Silicone rubber | 0.5 | Belt | Ceramic heater | (A) | — | 45 | 100 | 120 |

TABLE 1-continued

| Example No. | Transporting Belt: Support member | Transporting Belt: Material of Surface Portion | Transporting Belt: Peel Strength with respect to Adhesive Layer (g/mm) | Pressure-application Member | Heating Means: Heater | Heating Means: Heating mode (**) | Separating Means for Label | Difference in Two Temp.(*) | Transporting Speed (mm/sec) | Heat Activation Temp. (° C.) |
|---|---|---|---|---|---|---|---|---|---|---|
| Ex. 5 | Nickel | Silicone rubber | 0.5 | Belt | Ceramic heater | (A) | — | 20 | 100 | 120 |
| Ex. 6 | Nickel | Silicone rubber | 0.5 | Belt | Ceramic heater | (A) | — | 9 | 100 | 120 |
| Ex. 7 | Nickel | Silicone rubber | 0.5 | Belt | Ceramic heater | (A) | — | 50 | 100 | 120 |
| Ex. 8 | Nickel | Silicone rubber | 0.5 | Belt | Ceramic heater | (A) | — | 40 | 100 | 120 |
| Ex. 9 | Nickel | Silicone rubber | 0.5 | Rubber roller | Ceramic heater | (A) | — | 45 | 100 | 120 |
| Ex. 10 | Nickel | Teflon | 6 | Belt | Halogen lamp | (B) | — | 45 | 80 | 120 |
| Ex. 11 | Nickel | Silicone rubber | 0.5 | Belt | Silicone rubber heater | (A) | — | 45 | 100 | 120 |
| Ex. 12 | Nickel | Silicone rubber | 0.5 | Belt | roller with halogen lamp inside | (A) | — | 45 | 100 | 120 |
| Ex. 13 | Nickel | Silicone rubber | 0.5 | Belt | Halogen lamp | (B) | — | 45 | 80 | 120 |
| Ex. 14 | Nickel | Silicone rubber | 0.5 | Rubber roller | Ceramic heater | (A) | Sharp bending of transporting belt | 45 | 100 | 120 |
| Comp. Ex. 1 | Nickel | Silicone rubber | 0.5 | — | Ceramic heater | (A) | — | 45 | 100 | 120 |
| Comp Ex. 2 | Nickel | Teflon | 6 | — | Ceramic heater | (A) | Sharp bending of transporting belt | 45 | 100 | 120 |

(*)(Meat activation temperature of thermosensitive adhesive layer)-
(Coloring initiation temperature of thermosensitive coloring layer)
(**)(A): The heater is in contact with the inner surface of the transporting belt.
(B): The heater is situated outside the transporting belt, riot in contact with the belt.

TABLE 2

| Example No. | Heat-Activation Temp. (°0 C.) | Adhesion of Adhesive Layer after Heat Activation | Transferring of Adhesive Layer to Transporting Belt | Background Density: Before heat activation | Background Density: After heat activation | Dynamic Coloring Density: 0.4 ms | Dynamic Coloring Density: 0.5 ms |
|---|---|---|---|---|---|---|---|
| Ex. 1 | 120 | ⊚ | ⊚ | 0.07 | 0.07 | 0.72 | 1.15 |
| | 80 | ○ | ⊚ | 0.07 | 0.07 | | |
| | 50 | Δ | ⊚ | 0.07 | 0.07 | | |
| Ex. 2 | 120 | ⊚ | ⊚ | 0.07 | 0.07 | 0.72 | 1.16 |
| Ex. 3 | 120 | ⊚ | ⊚ | 0.07 | 0.07 | 0.65 | 1.07 |
| Ex. 4 | 120 | ⊚ | ⊚ | 0.07 | 0.07 | 0.60 | 1.01 |
| Ex. 5 | 120 | ⊚ | ⊚ | 0.07 | 0.10 | 0.77 | 1.19 |
| Ex. 6 | 120 | ⊚ | ⊚ | 0.07 | 0.13 | 0.83 | 1.22 |
| Ex. 7 | 120 | ⊚ | ⊚ | 0.07 | 0.07 | 0.72 | 1.16 |
| Ex. 8 | 120 | ⊚ | ⊚ | 0.07 | 0.07 | 0.73 | 1.15 |
| Ex. 9 | 120 | ⊚ | ⊚ | 0.07 | 0.07 | 0.72 | 1.16 |
| Ex. 10 | 120 | ⊚ | ○ | 0.07 | 0.07 | 0.72 | 1.15 |
| Ex. 11 | 120 | ⊚ | ⊚ | 0.07 | 0.07 | 0.72 | 1.15 |
| Ex. 12 | 120 | ⊚ | ⊚ | 0.07 | 0.07 | 0.73 | 1.15 |
| Ex. 13 | 120 | ⊚ | ⊚ | 0.07 | 0.07 | 0.73 | 1.16 |
| Ex. 14 | 120 | ⊚ | ⊚ | 0.07 | 0.07 | 0.73 | 1.15 |
| Comp. Ex. 1 | 120 | Δ | ⊚ | 0.07 | 0.07 | 0.73 | 1.15 |
| Comp. Ex. 2 | 120 | Δ | ⊚ | 0.07 | 0.07 | 0.73 | 1.16 |

Japanese Patent Application No. 08-275978 filed Oct. 18, 1996 and Japanese Patent Application No. 08-275979 filed Oct. 18, 1996 are hereby incorporated by reference.

What is claimed is:

1. A heat activation method for activating a thermosensitive adhesive label comprising a support and a thermosensitive adhesive layer which is provided on said support and is not adhesive at room temperature, so as to make said thermosensitive adhesive layer adhesive with the application of heat thereto, comprising the step of:

heating said thermosensitive adhesive layer so as to make said thermosensitive adhesive layer adhesive while transporting said thermosensitive adhesive label along a heat-resistant transporting belt which is heated by a heater, with said thermosensitive adhesive layer being in pressure contact with said transporting belt using a pressure-application member.

2. The heat activation method as claimed in claim 1, further comprising the step of separating said thermosensitive adhesive label from said transporting belt after heat-activating said thermosensitive adhesive layer by curving said thermosensitive adhesive label in a direction away from said heat-resistant transporting belt.

3. The heat activation method as claimed in claim 2, wherein said thermosensitive adhesive label is separated from said transporting belt with the application of pressure to a linear superimposed area of said thermosensitive adhesive label and said transporting belt so as to make said linear superimposed area concave, which linear superimposed area extends in the direction normal to the transporting direction of said thermosensitive adhesive label.

4. The heat activation method as claimed in claim 3, wherein said application of pressure to a linear superposed area is effected by a pressure-application separator which comprises a press roller.

5. The heat activation method as claimed in claim 3, wherein said pressure-application separator comprises a press plate.

6. The heat activation method as claimed in claim 1, wherein said thermosensitive adhesive label further comprises a thermosensitive coloring layer which is provided on said support, opposite to said thermosensitive adhesive layer with respect to said support.

7. The heat activation method as claimed in claim 6, wherein a coloring initiation-temperature of said thermosensitive coloring layer is higher than a heat activation temperature of said thermosensitive adhesive layer by 10° C. or more.

8. The heat activation method as claimed in claim 6, wherein said thermosensitive adhesive label further comprises a heat insulating layer which is provided between said support and said thermosensitive coloring layer.

9. The heat activation method as claimed in claim 8, wherein said thermosensitive adhesive label further comprises a heat insulating layer which is provided between said support and said thermosensitive adhesive layer.

10. The heat activation method as claimed in claim 8, wherein said heat insulating layer comprises non-expandable minute void particles with a voidage of 30% or more, each particle comprising a thermoplastic resin for forming a shell.

11. The heat activation method as claimed in claim 6, wherein said thermosensitive adhesive label further comprises a heat insulating layer which is provided between said support and said thermosensitive adhesive layer.

12. An apparatus for heat-activating a thermosensitive adhesive label comprising a support and a thermosensitive adhesive layer which is provided on said support and is not adhesive at room temperature, so as to make said thermosensitive adhesive layer adhesive with the application of heat thereto, comprising:

a heat-application and transporting member for heating said thermosensitive adhesive layer of said thermosensitive adhesive label so as to make said thermosensitive adhesive layer adhesive while transporting said thermosensitive adhesive label, and a pressure-application member for bringing said thermosensitive adhesive layer of said thermosensitive adhesive label into pressure contact with said heat-application and transporting member.

13. The heat activation apparatus as claimed in claim 12, wherein said heat-application and transporting member is a heat-resistant transporting belt which is heated by a heater.

14. The heat activation apparatus as claimed in claim 13, wherein said heat-resistant transporting belt comprises a surface portion which has a peel strength of 2 g/mm or less with respect to said thermosensitive adhesive layer, which is measured by applying said thermosensitive adhesive layer to said surface portion of said heat-resistant transporting belt, heating said thermosensitive adhesive layer to 90° C. for one minute under the application of a load of 2 kg thereto, and measuring the force required to peel said thermosensitive adhesive layer from said surface portion of said transporting belt under T-peel condition at room temperature at a peeling speed of 300 mm/minute.

15. The heat activation apparatus as claimed in claim 14, wherein said surface portion of said heat-resistant transporting belt comprises a silicone rubber or a silicone resin.

16. The heat activation apparatus as claimed in claim 12, wherein said pressure-application member is a pressure-application belt.

17. The heat activation apparatus as claimed in claim 12, wherein said pressure-application member is a pressure-application roller.

18. The heat activation apparatus as claimed in claim 13, further comprising a separator for separating said thermosensitive adhesive label from said heat-resistant transporting belt after heat-activating said thermosensitive adhesive layer, by curving said thermosensitive adhesive label in a direction away from said heat-resistant transporting belt.

19. The heat activation apparatus as claimed in claim 18, wherein said separator is a pressure-application separator which applies pressure to a linear superimposed area of said thermosensitive adhesive label and said transporting belt so as to make said linear superimposed area concave, which linear superimposed area extends in the direction normal to the transporting direction of said thermosensitive adhesive label.

20. The heat activation apparatus as claimed in claim 19, wherein said pressure-application separator comprises a press roller.

21. The heat activation apparatus as claimed in claim 19, wherein said pressure-application separator comprises a press plate.

22. The heat activation apparatus as claimed in claim 12, wherein said thermosensitive adhesive label further comprises a thermosensitive coloring layer which is provided on said support, opposite to said thermosensitive adhesive layer with respect to said support.

23. The heat activation apparatus as claimed in claim 22, wherein a coloring initiation temperature of said thermosensitive coloring layer is higher than a heat activation temperature of said thermosensitive adhesive layer by 10° C. or more.

24. The heat activation apparatus as claimed in claim 22, wherein said thermosensitive adhesive label further comprises a heat insulating layer which is provided between said support and said thermosensitive coloring layer.

25. The heat activation apparatus as claimed in claim 24, wherein said thermosensitive adhesive label further comprises a heat insulating layer which is provided between said support and said thermosensitive adhesive layer.

26. The heat activation apparatus as claimed in claim 24, wherein said heat insulating layer comprises non-expandable minute void particles with a voidage of 30% or more, each particle comprising a thermoplastic resin for forming a shell.

27. The heat activation apparatus as claimed in claim 22, wherein said thermosensitive adhesive label further comprises a heat insulating layer which is provided between said support and said thermosensitive adhesive layer.

28. A label printer which comprises:

a label holder for holding a thermosensitive adhesive label comprising a support, a thermosensitive adhesive layer which is provided on one side of said support and is not adhesive at room temperature, and a thermosensitive coloring layer provided on the other side of said support, opposite to said thermosensitive adhesive layer with respect to said support;

a printing apparatus for printing an image on said thermosensitive coloring layer of said thermosensitive adhesive label;

a cutter for cutting said thermosensitive adhesive label to a predetermined length; and a heat activator for heat-activating said thermosensitive adhesive layer of said thermosensitive adhesive label so as to make said thermosensitive adhesive layer adhesive, said heat activator comprising a heat-application and transporting member for heating said thermosensitive adhesive layer of said thermosensitive adhesive label while transporting said thermosensitive adhesive label, and a pressure-application member for bringing said thermosensitive adhesive layer of said thermosensitive adhesive label into pressure contact with said heat-application and transporting member.

29. The label printer as claimed in claim 28, wherein said heat-application and transporting member for use in said heat activator is a heat-resistant transporting belt which is heated by a heater.

30. The label printer as claimed in claim 29, wherein said heat activator further comprises a separator for separating said thermosensitive adhesive label from said heat-resistant transporting belt after heat-activating said thermosensitive adhesive layer, by curving said thermosensitive adhesive label in a direction away from said heat-resistant transporting belt.

31. The label printer as claimed in claim 30, wherein said separator is a pressure-application separator which applies pressure to a linear superimposed area of said thermosensitive adhesive label and said transporting belt so as to make said linear superimposed area concave, which linear superimposed area extends in the direction normal to the transporting direction of said thermosensitive adhesive label.

32. The label printer as claimed in claim 31, wherein said pressure-application separator comprises a press roller.

33. The label printer as claimed in claim 31, wherein said pressure-application separator comprises a press plate.

34. The label printer as claimed in claim 28, wherein said pressure-application member for use in said heat activator is a pressure-application belt.

35. The label printer as claimed in claim 28, wherein said pressure-application member for use in said heat activator is a pressure-application roller.

36. The label printer as claimed in claim 28, wherein a coloring initiation temperature of said thermosensitive coloring layer is higher than a heat activation temperature of said thermosensitive adhesive layer by 10° C. or more.

37. The label printer as claimed in claim 28, wherein said thermosensitive adhesive label further comprises a heat insulating layer which is provided between said support and said thermosensitive coloring layer.

38. The label printer as claimed in claim 37, wherein said thermosensitive adhesive label further comprises a heat insulating layer which is provided between said support and said thermosensitive adhesive layer.

39. The label printer as claimed in claim 37, wherein said heat insulating layer comprises non-expandable minute void particles with a voidage of 30% or more, each particle comprising a thermoplastic resin for forming a shell.

40. The label printer as claimed in claim 28, wherein said thermosensitive adhesive label further comprises a heat insulating layer which is provided between said support and said thermosensitive adhesive layer.

* * * * *